US006962197B2

(12) United States Patent
Khomynets

(10) Patent No.: US 6,962,197 B2
(45) Date of Patent: Nov. 8, 2005

(54) BORE-HOLE-JET DEVICE FOR FORMATION TESTING AND A PRESTARTING PROCEDURE FOR SAID DEVICE

(76) Inventor: Zinoviy Dmitrievich Khomynets, d. 33, ul. Vilshanetskaya, Tismenitsa, obl.Ivano-Frankovskaya 77400 (UA)

( * ) Notice: Subject to any disclaimer, the term of this patent is extended or adjusted under 35 U.S.C. 154(b) by 0 days.

(21) Appl. No.: 10/415,171

(22) PCT Filed: Oct. 23, 2001

(86) PCT No.: PCT/RU01/00439

§ 371 (c)(1),
(2), (4) Date: Apr. 24, 2003

(87) PCT Pub. No.: WO02/35101

PCT Pub. Date: May 2, 2002

(65) Prior Publication Data

US 2004/0182570 A1 Sep. 23, 2004

(30) Foreign Application Priority Data

Oct. 25, 2000 (RU) ..... 2000126652
Oct. 30, 2000 (RU) ..... 2000126979

(51) Int. Cl.[7] ..... E21B 43/16; E21B 47/00
(52) U.S. Cl. ..... 166/254.2; 166/66; 166/68; 166/105; 166/250.11; 166/372
(58) Field of Search ..... 166/68, 66, 105, 166/254.2, 250.11, 250.01, 372

(56) References Cited

U.S. PATENT DOCUMENTS 4,744,730 A 5/1988 Roeder
2004/0129416 A1 * 7/2004 Khomynets ..... 166/105
2004/0134663 A1 * 7/2004 Khomynets ..... 166/372

FOREIGN PATENT DOCUMENTS

| | | |
|---|---|---|
| RU | 2129671 | 4/1999 |
| RU | 2143597 | 12/1999 |
| SU | 1146416 | 3/1985 |
| SU | 1321942 | 7/1987 |
| SU | 1545011 | 2/1990 |
| SU | 1668646 | 8/1991 |

* cited by examiner

*Primary Examiner*—Hoang Dang
(74) *Attorney, Agent, or Firm*—Dellett & Walters

(57) ABSTRACT

The invention relates to fluidics, in particular to jet devices for lifting various liquids, essentially for lifting petrol out of wells and for well examination. The inventive jet device comprises a packer and a flow column provided with a bearing assembly. Bypass openings are embodied in said bearing assembly and a jet pump is arranged inside the body thereof. A channel for running a medium mixture off the jet pump into an annular space connected to the bypass openings, a channel for supplying fluid pumped-out from the well to the jet pump and a channel for supplying ejecting medium to a nozzle of the jet pump are embodied inside the body. In addition, a pressure-sealing unit is arranged in the channel for supplying the pumped-out fluid in such a way that it is superposed with respect to the jet pump. A bypass channel is embodied in the pressure-sealing unit in such a way that it enables a logging cable to be passed through said channel and the channel for supplying the pumped-out liquid. The logging cable makes it possible to arrange instruments and equipment in the well below the jet pump in such a way that they can move along the borehole.

2 Claims, 3 Drawing Sheets

BORE-HOLE-JET DEVICE FOR FORMATION TESTING AND A PRESTARTING PROCEDURE FOR SAID DEVICE

FIELD OF INVENTION

This invention relates to jet devices, and, more particularly, to jet devices for lifting various fluids, in particular oil, out of wells, and for well surveys.

PRIOR ART

Known in the art is the downhole jet device assembly comprising a flow string with a string support having drainage windows, and further comprising a jet pump unit installed in the said string (SU 1321942 A).

The said downhole jet device assembly provides the possibility to install a jet pump in a well without raising the flow string. However, the process of extraction and installation of the said jet pump requires that special technological equipment be exploited, thus impeding its use.

Also known in the art is a method of operation of a downhole jet device assembly, which includes supply of an active medium to the throat of a jet-type pump, pumping a liquid medium out of the well due to the energy provided by the said active medium, and delivery of the medium mixture to the surface (SU 1545011 A).

The said method of operation of the downhole jet device assembly enables to pump liquid media out of wells. However, it is not possible to carry out the works associated with the effect on a producing formation in the process of the jet device assembly operation, which narrows the field of operation of the said jet device assembly.

The closest to the proposed device as to the technical essence and the achieved result is a borehole jet device assembly, which comprises a packer, a flow string with its support wherein drainage windows are made and on which a jet pump is installed in the case, the said case comprising a channel, communicating with the said drainage windows, for removing a medium mixture from the said jet pump into the well annular space, a channel for supplying the medium pumped out of the well to the said jet pump, and a channel for supplying the ejecting medium to the throat of the jet pump, and the said case further comprising a sealing assembly being arranged in the channel for supplying the pumped out medium above the jet pump; and the sealing assembly comprises a through channel with the possibility of leading, through the latter and the said channel for supplying the pumped out medium, a cable for the purpose of installing in the well, below the jet pump, instrumentation and equipment with the possibility of moving the same along the well bore (RU 2143597 C1).

The above-said jet device assembly enables to expand the field of its exploitation by providing the possibility of acting onto the bottomhole zone, but its application is difficult without exploiting and arranging support equipment on the said cable in the well, which narrows the field of operation of the said jet device assembly.

The closest to the proposed method as to the technical essence and the achieved result is a prestarting procedure for a downhole jet device assembly, which includes the installation a flow string, a jet-type pump, and a packer into the well, the arrangement of instrumentation and equipment (in particular a physical field emitter-receiver) on the logging cable below the said jet pump, and the conduction of a formation survey as a necessary differential pressure drawdown has been created in the area below the packer (RU 2129671 C1).

This method enables to survey a borehole with the use of the instrumentation installed onto the logging cable. It is not possible, however, to simultaneously install a jet pump and the survey instrumentation, since it extends the period of borehole preparation for operation and does not allow, when necessary, to simultaneously remove the jet pump together with the instrumentation installed onto the logging cable out of the borehole. The replacement procedure for the jet pump is rather labor-consuming, since it requires lifting of the flow string and, in the long run, reduces the capacity of the jet device assembly when a borehole survey is conducted.

DISCLOSURE OF THE INVENTION

The objective of this invention is to expand the functional capabilities of a borehole jet device assembly by ensuring the possibility of using it both in the mode of surveying the borehole below the jet pump assembly when the range of survey is enlarged and in the normal operational mode of the jet device assembly when it is used for pumping out of various media, predominantly oil, out of the well with the possibility to control the parameters of such media.

With regard to the device, the objective is achieved in such a way that the borehole jet device assembly comprises a packer, a flow string with its support wherein drainage windows are made and on which a jet pump is installed in the case, the said case comprising a channel, communicating with the said drainage windows, for removal of a medium mixture from the said jet pump into the well annular space, a channel for supplying the medium extracted from the borehole to the said jet pump, and a channel for supplying the ejecting medium to the throat of the jet pump, and the sealing assembly comprising a through channel with the possibility of leading, through the latter and the said channel for supplying the extracted fluid, a cable for the purpose of installing, below the said jet pump, instrumentation and equipment with the possibility of moving the same along the well bore. According to the invention the sealing assembly is made with the possibility of installing in it, with closing the through channel, a device for delivering the case with the jet pump into the borehole and removing it therefrom; and in the lower part of the jet pump case a threaded hole is made for attaching autonomous instrumentation to the case, the outer diameter D of the case being at least 2.0 mm less than the least inner diameter $D_1$ of the flow string arranged above the support.

With regard to the method, the objective of this invention is achieved in such a way that during the prestarting procedure for the borehole jet device assembly, which includes the installation a flow string, a jet-type pump, and a packer into the well, the arrangement of instrumentation and equipment onto the logging cable below the said jet pump, and the conduction of a formation survey as a necessary differential pressure drawdown has been created in the area below the packer, according to this invention the support with drainage windows is installed on the flow string above the formation, and thereafter the jet pump, instrumentation and equipment are simultaneously lowered on the logging cable, and the jet pump is installed onto the support and below the jet pump the instrumentation and equipment are arranged, the latter being installed with the possibility of being reciprocally moved along the well bore.

As the conducted works have shown, the described structure of the borehole jet device assembly enables to operate it both with the use of various pieces of equipment for acting upon the pumped out medium in the borehole area below the jet pump and without any special equipment, i.e., for normal pumping-out of liquid medium out of the well. The proposed use of a tool for the delivery into/removal from the well of the case together with the jet pump enables to solve two tasks: first, to ensure a sufficient sealing of the through channel in the sealing assembly and, second, to install in the upper part of the case, above the jet pump, the tool enabling to easily deliver the jet pump into the well and remove it from the well. In a case of the replacement of the jet pump with another one it would be not necessary to dismount the flow string from the packer and to lift it to the surface. It would be enough to remove the jet pump from its support and lift it on the logging cable to the surface. Then, another jet pump, having, for example, other characteristics, may be installed. The proposed design of the jet device assembly enables to use it in the process of works carried out in the well in different modes of pumping out the medium with the highest efficiency by installing the jet pump with the required specifications into the case; moreover, when necessary, it is possible to install in the well, below the jet pump, various pieces of equipment both onto the cable, which is led through the sealing assembly, and without such a cable by suspending various pieces of equipment below the said jet pump and fixing them in the sealing assembly or in the lower part of the jet pump case. Of similar importance are the outer dimensions of the case, into which the jet pump is to be installed. It has been found out that the outer diameter of the case should be at least 2 millimeters less than the least inner diameter of the flow string arranged above the support. It is just this relationship between the case dimensions and the flow area of the flow string that enables to freely lead through the flow string and install the case with the jet pump on the support in the flow string. At the same time a possibility of conducting various geophysical studies in the mode of a given value of the differential pressure drawdown, acting upon a formation or formations with ultrasound or other physical fields, conducting well treatment and bottomhole zone treatment in a dynamic or pulse mode as well as shooting the casing pipe.

Thus, the objective of this invention is achieved—to expand the functional possibilities of the borehole jet device assembly.

DETAILED DESCRIPTION OF THE PREFERRED EMBODIMENT

Figure 1:
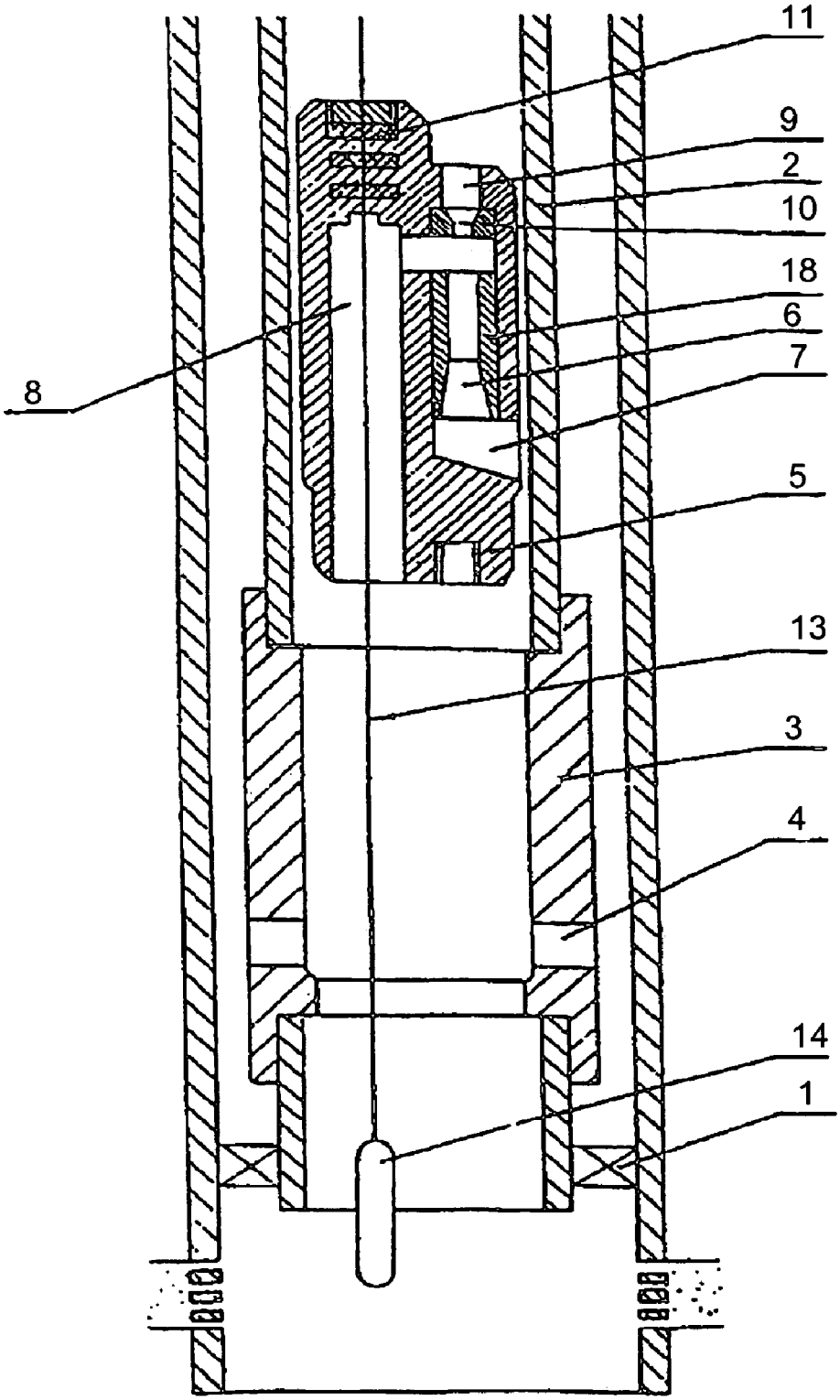
FIG. 1 is an illustration of the described downhole jet device assembly shown at the time of lowering the jet pump.
Figure 2:
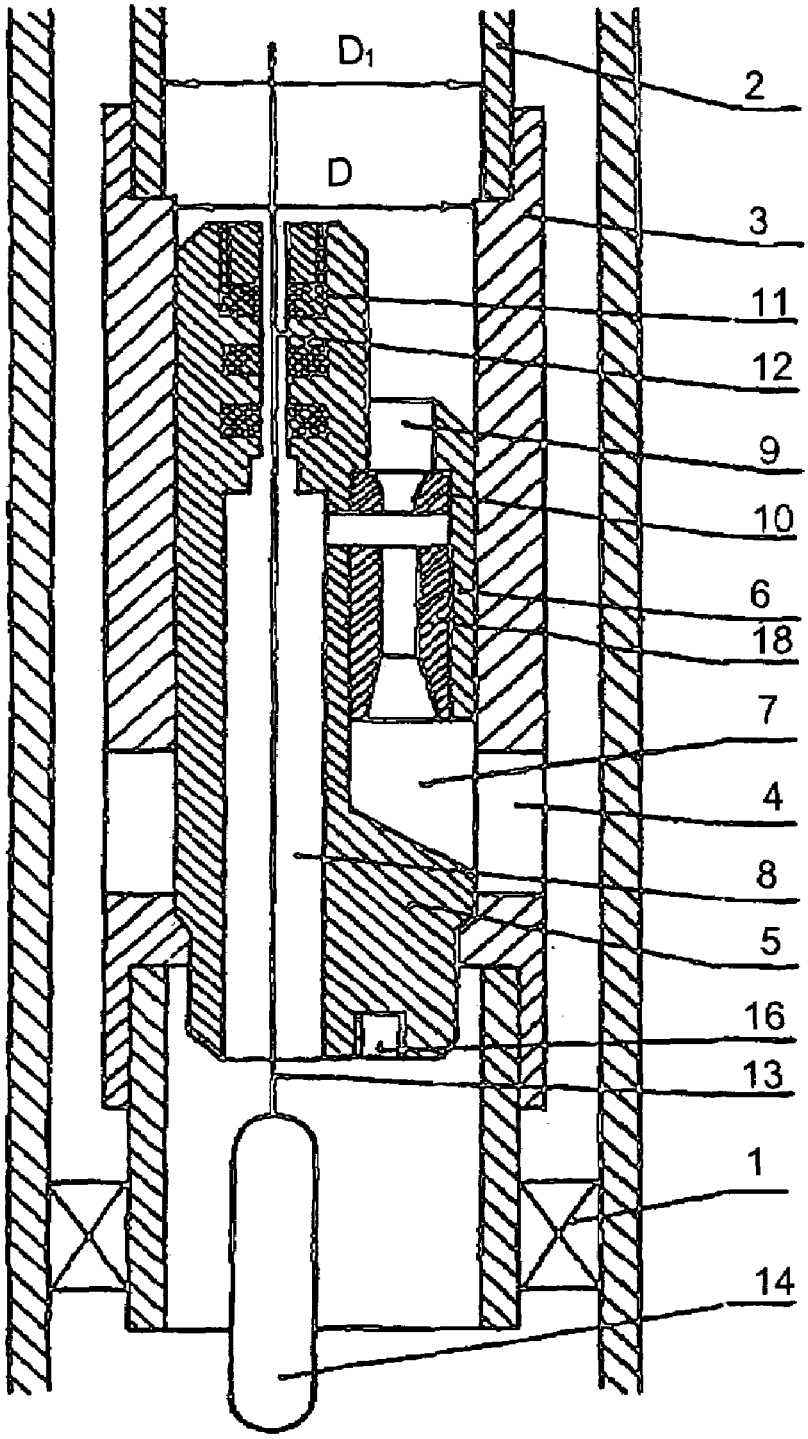
FIG. 2 is a schematic cross-section view of the described downhole jet device assembly.
Figure 3:
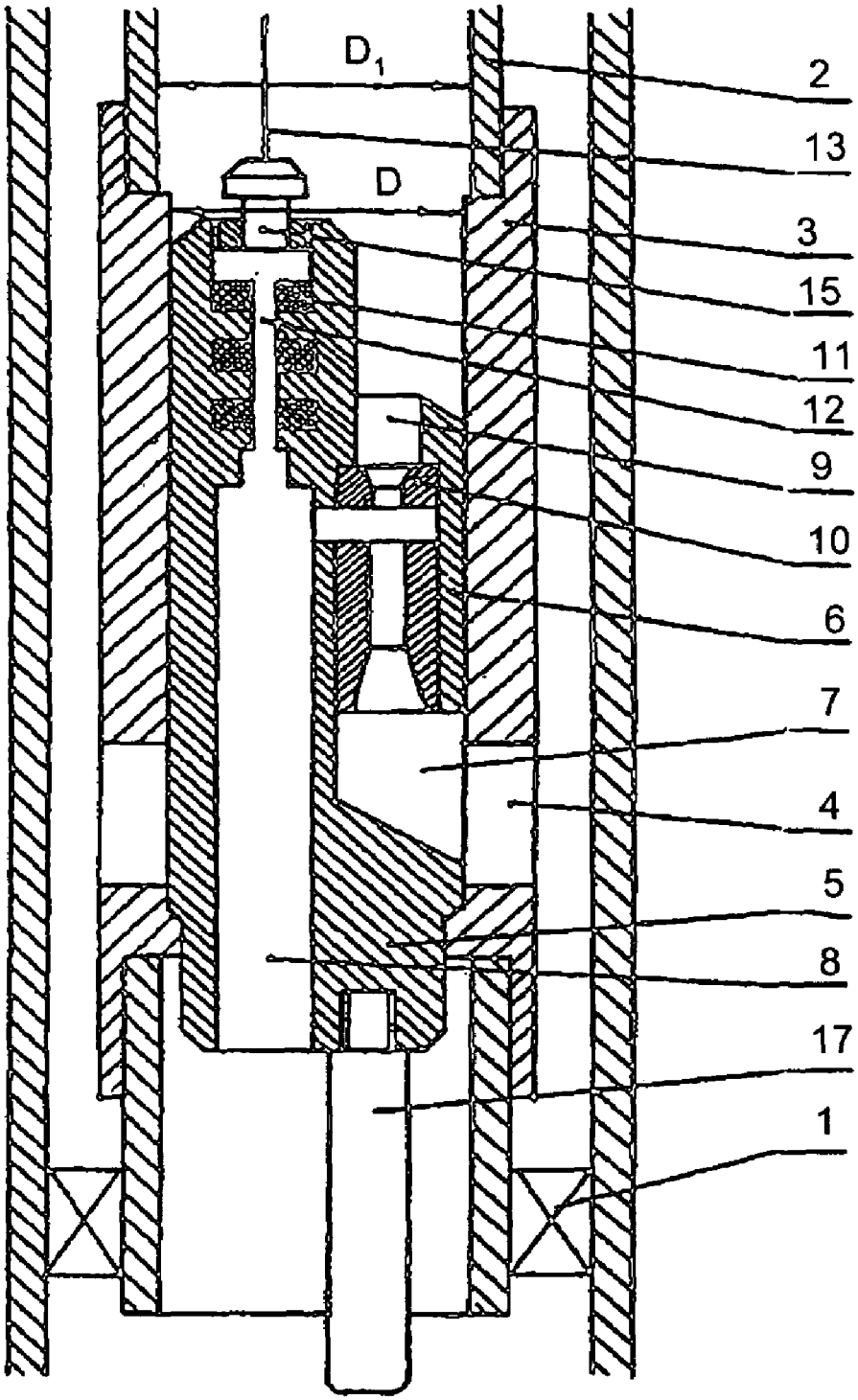
FIG. 3 is a schematic cross-section view of the assembly in the operation mode with stationary equipment installed in the well, below the jet pump, with the closed channel in the sealing assembly.

The borehole jet device assembly, which realizes the proposed method, comprises the packer 1, the flow string 2 with the support 3, in which the drainage windows 4 are made and on which the jet pump 6 is installed in the case 5, the said case 5 having the channel 7, communicating with the drainage windows 4, for removing a medium mixture from the said jet pump into the well annular space, the channel 8 for supplying the medium extracted from the borehole to the said jet pump, and the channel 9 for supplying the ejecting medium to the throat 10 of the jet pump 6 and the sealing assembly 11 having the through channel 12 with the possibility of leading, through the latter and the said channel 8 for supplying the extracted fluid, the logging cable 13 for the purpose of installing, below the said jet pump 6, instrumentation and equipment 14 with the possibility of moving the same along the well bore. The sealing assembly 11 is made with the possibility of installing in it, with closing the through channel 12, the tool 15 for delivering the case 5 with the jet pump 6 into the well and removing same from the well. In the lower part of the case 5 of the jet pump 6 a threaded hole 16 is made for the purpose of attaching the stationary measuring equipment 17, which is intended for autonomously recording the parameters of the pumped out medium and bottomhole pressures, to the case 5. Moreover, the outer diameter D of the case 5 is at least 2.0 mm less than the least inner diameter $D_1$ of the flow string 2.

The described prestarting procedure for the borehole jet device assembly is realized as follows.

First, the flow string 2, together with the support 3 for the case 5 of the jet pump 6 and the packer 1, as installed thereon, is lowered into the well. When the support 3 achieves a predetermined depth for the installation of the jet pump 6, the packer 1 is released. The jet pump 6, together with the stationary equipment 17 in the case 5, is lowered with the use of the tool 15 into the flow string 2 and is installed in the support 3. If necessary, the tool 15 is removed from the sealing assembly 12, and the cable 13, together with the installed thereon instrumentation and equipment 14 (in particular, an emitter/receiver of physical fields), is led via the through channel 12 for the purpose of carrying out works in the well below the jet pump 6. When the case 5 of the jet pump 6 is set on the support 3, the channel 7 for removing a medium mixture is aligned with the drainage windows 4 in the support 3 and, thereby, communicates with the well annular space. The ejecting medium is fed along the flow string 2 and through the channel 9 in the case 5 to the throat 10 of the jet pump 6. When flowing out of the throat 10, the ejecting medium entrains the formation fluid from the borehole area below the packer to the mixing chamber 18 of the jet pump 6, which enables to create a predetermined differential pressure drawdown by controlling the rate of pumping the ejecting medium. At the same time, the formations are acted upon by physical fields or the well is studied with the use of the instrumentation 14 and/or the stationary equipment 17. The formation testing mode is regulated by changing the pressure of the ejecting medium fed to the throat 10 of the jet pump 6. During the study the instrumentation 14 is moved along the well, and the well may be studied both while operating the jet pump 6 and after halting it.

If necessary, the jet pump 6 and/or the instrumentation 14 are replaced.

INDUSTRIAL APPLICABILITY

This invention may be exploited in the mining industry or the petroleum industry for conducting works on testing wells and production of liquid and gaseous media from wells, with the possibility of conducting a wide range of works in wells in order to raise their productivity and perform various repairs.

What is claimed is:

1. A well jet pump assembly, which comprises a packer, a flow string with a support in which drainage windows are made and on which a case including a jet pump is installed, the case comprising a channel communicating with said drainage windows for removing a medium mixture from the jet pump into a well annular space, a channel for supplying a production fluid to the jet pump, and a channel for supplying a power fluid to the throat of the jet pump, and the case further comprising a sealing assembly being arranged in the channel for supplying a well production fluid to the jet pump, the sealing assembly comprising a through channel with the possibility of leading, through the latter and the channel for supplying the production fluid, a logging cable for the purpose of installing in the well, below the jet pump, instrumentation and equipment with the possibility of moving the same along the well bore, characterized in that the sealing assembly is made with the possibility of installing in it, with closing the through channel, a tool for delivering the case with the jet pump into the well bore and removing it therefrom, and in the lower part of the jet pump case a threaded hole is made for attaching autonomous instrumentation to the case, the outer diameter D of the case being at least 2.0 mm less than the least inner diameter D1 of the flow string arranged above the support.

2. A method for installing a downhole well jet pump assembly in a flow string having a support in which drainage windows are made and on which a case including a jet pump is installed, the case comprising a channel communicating with the drainage windows for removing a fluid mixture from the jet pump into an well annular space, a channel for supplying a production fluid to the jet pump, and a channel for supplying a power fluid to the throat of the jet pump, and the case further comprising a sealing assembly being arranged in the said channel for a production fluid to the jet pump, the sealing assembly comprising a through channel with the possibility of leading, through the latter and the channel for supplying a production fluid, a logging cable for the purpose of installing in the well, below the jet pump, instrumentation and equipment with the possibility of moving the same along the well bore after the case is landed on the support, comprising the steps of:

extending the lower end of the logging cable through the channel of the sealing assembly and the jet pump channel for supplying a production fluid;

connecting the lower end of the logging cable with the instrumentation and equipment;

lowering the logging cable together with the instrumentation and equipment and the jet pump case through the flow string;

landing the jet pump case on the support; and thereafter moving the instrumentation and equipment relative to the jet pump case.

* * * * *